United States Patent [19]

Metcalfe et al.

[11] 3,946,671

[45] Mar. 30, 1976

[54] ELECTROSTATIC OFFSET PRINTING

[75] Inventors: Kenneth Archibald Metcalfe, Lockleys; Clive Westgarth Wilson, Oaklands Park, both of Australia

[73] Assignee: The Commonwealth of Australia, Canberra, Australia

[22] Filed: Sept. 26, 1973

[21] Appl. No.: 401,107

[30] Foreign Application Priority Data

Sept. 28, 1972 Australia ..... 627/72

[52] U.S. Cl. ..... 101/426; 101/DIG. 13; 427/16

[51] Int. Cl.[2] ..... G03G 9/12; B05C 1/16

[58] Field of Search ..... 101/426, DIG. 13, 451, 101/452, 465, 466; 96/1 R, 1.4; 117/37 LE, 17.5; 427/16

[56] References Cited

UNITED STATES PATENTS

| | | | |
|---|---|---|---|
| 2,988,988 | 6/1961 | Kurz | 101/451 |
| 3,107,169 | 10/1963 | Bornarth | 101/466 X |
| 3,247,794 | 4/1966 | Zabiak | 101/DIG. 13 |
| 3,256,197 | 6/1966 | Fauser et al. | 101/DIG. 13 |
| 3,262,806 | 7/1966 | Gourge | 101/DIG. 13 |
| 3,306,198 | 2/1967 | Rarey | 101/DIG. 13 |
| 3,328,193 | 6/1967 | Oliphant et al. | 101/DIG. 13 |
| 3,338,164 | 8/1967 | Webers | 101/466 X |
| 3,345,944 | 10/1967 | Simmons | 101/DIG. 13 |
| 3,351,008 | 11/1967 | Lincoln et al. | 101/465 |
| 3,532,054 | 10/1970 | Zaphiropoulus | 101/DIG. 13 |
| 3,554,125 | 1/1971 | Van Dorn et al. | 101/451 |
| 3,617,266 | 11/1971 | Williams | 101/451 |
| 3,661,081 | 5/1972 | Wright | 101/DIG. 13 |
| 3,697,268 | 10/1972 | Ohta | 101/465 |
| 3,698,312 | 10/1972 | Muller | 101/451 |
| 3,745,028 | 7/1973 | Rauner et al. | 101/451 |

*Primary Examiner*—E. H. Eickholt

*Attorney, Agent, or Firm*—Haseltine, Lake & Waters

[57] ABSTRACT

A method of printing comprising applying a conductive developer to a imaged dielectric surface in the presence of an energising electrical image-defining field to form a master having conductive and relatively insulating areas defining the image, inking the said surface in the presence of a field of a polarity to urge the ink on to the surface to retain it at the relatively insulating image areas, and transferring the ink from the said surface to a receiving surface in the presence of a field of a polarity to urge the ink on to the receiving surface, and continuing inking the said master and transferring the ink to further receiving sheets.

6 Claims, 3 Drawing Figures

ELECTROSTATIC OFFSET PRINTING

BACKGROUND OF THE INVENTION

This invention relates to an electric offset printing system and in particular it relates to a system which does not require the use of water in effecting offset printing.

In the art of offset printing it is customary to provide a plate which has part of the surface hydrophilic and the other part hydrophobic, the image being formed by the difference in the water acceptance of the various areas.

It has already been proposed to produce printing plates with hydrophilic and hydrophobic areas by means of xerographic methods, but in all known forms of printing by the offset principle it is necessary to treat the plate from which the printing is to be effected to provide these hydrophilic and hydrophobic areas and to then use water as a medium which prevents the inking of the area which is not to accept printing ink.

It would be highly advantageous if the method could be evolved which did not require this wetting and it is an object of the present invention to provide such a method.

SUMMARY OF INVENTION

We have found that it is possible to print from an area which contains an image defined by the dielectric constant of the surface, the method of using such a surface varying according to the modifications of this invention, but according to one form of the invention a membrane containing an image differing from the non-image areas by its dielectric constant, can be developed with a conductive developer medium or medium of high dielectric constant and it will be found that the developer will be applied selectively according to the dielectric constant of the image areas.

The image so formed on the imaging membrane or master can then be transferred to another medium such as paper, or the membrane can be used as a plate which can be inked in a selected manner for instance in those areas where the conductive developer did not go down, and the ink can be transferred by an offset process but without the need of wetting the surface because the ink will have been accepted by the master only in the area where the conductive developer has not previously be deposited.

We have found for instance that it is possible to take a sheet of photoconductive paper having a latent image thereon and to develop this with a conductive developer by passing a roller containing the developer over the surface. Similarly we can take a sheet of ordinary letterpress or a typed sheet and develop this with a conductive developer by passing a roller containing the developer over the surface and applying to the roller a bias which acts between the roller and the backing plate for the surface on which the paper containing the letterpress image or printing is placed.

Such a surface can then be inked with an appropriate developer which will however go down in those areas where no conductive developer has previously been deposited and a surface is now provided which has the original image charged with a developer or printing ink which can then be directly offset on to paper or the like and this process can be continued as often as is necessary during printing, because each time the printing ink or developer which is applied will only go down on the area which is not protected by the conductive developer medium.

The basis of the invention appears to be the discovery we have made that where a developer is conductive, or has a high dielectric constant such a developer can not remain in position on a surface containing a latent image because a conductive developer immediately exchanges charges with the area and is rejected or moved away when the charges are equalised because then the developer and the surface have the same polarity and repel, but when this developer moves away from the surface into a charged area of opposite polarity, an exchange again takes place and thus the developer shuttles forward and backward between the surface containing the latent image but on contact immediately releases or exchanges charges and again moves off.

When such a developer is applied by means of a roller which has a charge applied to it, this oscillation takes place when the roller passes over the surface, but immediately the roller has passed the surface, the conductive developer, even although it has exchanged charges, is out of the field which would lift it off and therefore it remains in position. The process can be considered essentially a dry one which inhibits exchange unless there is a field area to which the particles are attracted after exchanging charges.

The image left behind can then be fixed by heat fusion or any other means to provide a firmly adhering image or it can be fixed by spraying with a solvent or the like or it could be damped with a solvent prior to application so that immediately the roller has passed, the evaporation of the solvent will cause the image to become firmly attached.

It will be realised from the foregoing that the present invention is operative because the developers in the presence of the field are sensitive to dielectric constant differences and higher dielectric constant surfaces cause a discharging of the conductive particles under the conditions outlined. Thus a surface prepared in this way can be inked up in accordance with the dielectric constant difference of the surface without the application of any water and this surface can then be used as a printing master to produce multiple copies.

PREPARATION OF MASTERS

EXAMPLE A

A master for electrostatic printing is prepared by coating the following materials on to a high strength paper or metal sheet or film base or textile web:

| | |
|---|---|
| Polyvinyl butral resin, Mowital B60H (Hoechst) | 53 grams |
| dissolved in methyl ethyl ketone | 1000 milliliters |
| together with perchlorethylene | 500 milliliters |

EXAMPLE B

A master for electrostatic printing is prepared by coating the following materials on to a high strength paper, or metal sheet or polymer sheet or textile web:

| | |
|---|---|
| Short oil alkyd resin, Rhodene M8/50 (Polymer Corp) | 600 grams |
| dissolved in Acetone | 2500 milliliters |
| together with perchlorethylene | 1000 milliliters |

EXAMPLE C

An electrophotographic master for electrostatic printing is prepared by coating the following materials on to a high strength paper, or metal sheet or film base:

| | | |
|---|---|---|
| Zinc oxide (colloidal grade) (Durham Chemical Co.) | | 600 grams |
| mixed with: | polyvinyl butyral resin (Mowital B60H) (Hoechst) | 100 grams |
| dissolved in: | Methyl ethyl ketone | 1500 milliliters |
| | Methyl alcohol | 200 milliliters |
| | Acetone | 500 milliliters |
| | Toluene | 300 milliliters |
| | Perchlorethylene | 600 milliliters |

In Examples A, B, or C the coatings are applied by dip coating, roller coating, electrostatic coating or the like. Images for reproduction are produced on surfaces of Examples A and B by ordinary marking means such as typography, or by electrostatic recording from an electrified stylus. In Example C, images may be produced also by electrophotographic means either by charging techniques or by chargeless techniques.

EXAMPLE D

In Example C, the zinc oxide is replaced by any other photoconductor or photo-insulator such as cadmium sulphide, selenium, organic photoconductors or the like.

EXAMPLE E

In Examples A, B or C the resin is replaced by acrylic resins, or styrene-butadiene copolymers, or by phenolic resins or by varnishes or gums or by insulating substances such as phenolphthalein.

IMAGING MASTERS

The original letterpress or lithographic printed sheet or an electrophotographic copy of it if preferred is treated first to amplify the dielectric differences between the image and the background. This includes an electrophotographic copy of a continuous tone photograph. The treatment consists of applying to its surface a conductive suspension containing the following materials whilst an electric field, latent or active, is present:

| Suspension No. 1 | |
|---|---|
| Aluminium bronze powder | 100 grams |
| Alkyd resin P470 | 30 grams |
| Toluene | 15 mls. |
| dispersed in: | |
| Esso 100 | 50 mls. |
| Isopar G | 1000 mls. |

The suspension is rolled across the surface of the original printed sheet or copy with a potential of 10 to 500 volts applied between the roller and the backing plate or roller at web velocities for example 1 to 50 centimeters per. sec. or at a higher speeds at higher voltages. The suspension deposits out on the higher dielectric constant portions of the image and amplifies the differences between the original line, screen or tone images in relation to the background.

Suspension No. 2

In suspension No. 1, the aluminium bronze is replaced by silver, zinc, aluminium, chromium, iron, copper, tin or metal or alloy powders.

Suspension No. 3

In suspension No. 1, the resin is replaced by other alkyd resins, or by a phenolformaldehyde polymers, or shellac, polyethylene, polyisobutylene polyisoprene, polyvinylacetate, polymethylmethacrylate, cellulose, ethyl cellulose, ethyl hydroxy ethyl cellulose, cellulose acetate, polyvinylchloride, polyvinylbutyral, chlorinated rubber, polyamides, polyesters or the like.

Suspension No. 4

In Suspension No. 1, the metal powders are replaced by carbon black or other absorptive pigments or inorganic pigments, or dyes, first wetted with polar liquids or compounds or surface active agents to raise their conductivity and dielectric constant.

After the original or the copy has been so treated, to amplify the dielectric differences of the surface it is then wrapped around a drum and used as a printing master by applying an electric field of one polarity to ink it and transferring the ink dielectrically to ordinary paper by reversing the polarity or by using pulsating fields as taught by us in Australian Patent Application No. PB629/72 dated 28th September, 1972.

PRINTING FROM MASTERS

The inks for printing from the master so made can be exemplified as follows:

| INK 1 | |
|---|---|
| Kohinoor Carbon Black | 100 grams |
| Sunflower seed oil (Meggitts) | 300 grams |
| B.P.V. oil (Viscostatic) (British Petroleum) | 500 grams |
| Alkyd resin (1352/60) Super Beckosol | 200 grams |
| A. C. Hatrick Chemicals Aust. | |

This ink is applied to the master and deposits under dielectric control.

| INK 2 | Copolymeric Blue Ink |
|---|---|
| Hostaperm Blud B3G (Hoechst) | 100 grams |
| Styrene-butadiene copolymer e.g. "Solprene 1205" (Philips Imperial Chemicals) | 200 grams |
| Vinyl toluene-acrylate copolymer e.g. "Pliolite VTAC" (Australian Synthetic Rubber) | 100 grams |

The copolymeric resins were taken up in Solvesso 100 and subsequently milled with the blue pigment.

| INK 3 | Yellow Ink |
|---|---|
| Graphtol yellow 4813 - 0 | 40 grams |
| Solprene 1205 | 20 grams |
| VTAC | 10 grams |
| Dispersed in: | |
| Esso 100 | 100 mls. |

-continued

| INK 3 | Yellow Ink | |
|---|---|---|
| Isopar E | | 1000 mls. |
| INK 4 | Red Developer | |
| Graphtol Red 1630 | | 60 grams |
| Solprene 1205 | | 10 grams |
| VTL Copolymer | | 10 grams |
| Dispersed in: | | |
| Esso 100 | | 100 mls. |
| Isopar E | | 2000 mls. |

It is important to note that in the foregoing examples the coatings on the masters which receive the image generally have a dielectric constant after free solvent is evaporated of between 3 and 10, while the conductive developers have a dielectric constant in excess of 10 and may very substantially exceed this. These conditions ensure that fast charge exchanges are possible and operating field voltages can be kept low.

Chemical definitions

MOWITAL B60H polyvinyl butyral resin, made by Hoechst, Germany; containing polyvinyl acetal 76–78 percent, polyvinyl acetate 1 percent, and polyvinyl alcohol 18–21 percent.

RHODENE M8/50 Linseed oil resin, made by Hatrick Chemicals Pty. Ltd. C.I. Pigment 6–10, Oil Length 40, Viscosity XY Acid No. 6-10.

| | | |
|---|---|---|
| Excelsior | Channel (carbon) Black | Pigment CI:77266 |
| Kohinoor | ) | Black No. 7 |
| Peerless Black | ) | |
| Manufactured by A. C. Hatrick Pty. Ltd. | | |

HOSTAPERM BLUE B3G copper phthalocyanine blue, pure beta-form, made by Hoechst, C.I. pigment blue 15. Colour Index No. 74160.

GRAPHTOL YELLOW MONO AZO Dye Stuff Pigment, by SANDOZ LTD, Switzerland, C.I. Pigment 66, Colour Index No. 18000-1

GRAPHTOL RED MONO AZO DYE BY SANDOZ LTD. Switzerland C.I. Pigment Red 1. Colour Index No. 11000-680.

ESSO 100 Solvent is a hydrocarbon solvent supplied by Esso Chemicals Australia Limited, having an aromatic content of 98%, flash point of 108°F., and distillation range 159–182°C.

ISOPAR E is a hydrocarbon liquid solvent with greater than 95% isoparaffinic content, aromatics and olefins less than 1percent, with remainder cyclo-, and normal paraffins, KB No. 29, final boiling point 143°C.

ISOPAR G a hydrocarbon liquid solvent with greater than 95% isoparaffinic content, and aromatics and olefins less than 1 percent, and remainder cyclo-, and normal paraffins, KB No. 27, final boiling point 177°C.

B.P. Viscostatic Oil a mixture of synethetic low molecular weight polyester lubricants plus zinc dithiophosphate as a surfactant, (manufactured by British Petroleum Corp.)

BECKESOL ALKYD RESIN P470/70 a long oil phthalic anhydride synthetic alkyd resin by A. C. Hatrick Chemical Pty. Ltd. Colour (A.S.T.M. D 1544-63T) 4-7, Acid number 3-7.

Super Beckosol 1352/60 is a Isophthalic Acid modified penterythritol alkyo resin manufactured by A. C. Hatrick Chemical Pty. Ltd.

SOLPRENE 1205 (Phillips Imperial Chemicals Ltd.) is a block co-polymer of butadiene and styrene in the ratio of 75/25 manufactured by the solution polymerization process. Contains 97.5 rubber hydrocarbon. It is stabilized by addition of 1% of a non-staining anti-oxidant.

The majority of the styrene molecules are added as polystyrene at the end of a long chain of butadiene units.

PLIOLITE VT COPOLYMER is a styrene/butadiene type copolymer rubber made by Goodyear Corp., U.S.A. and prepared by the "G.R.S." method in which the butadiene polymerises in the main by a 1,4-addition. Pliolite VT is a vinyl toluene/butadiene random copolymer rubber soluble in mineral spirits.

PLIOLITE VTL COPOLYMER is a low solution viscosity vinyl-toluene-butadiene copolymeric thermoplastic rubber readily soluble in aliphatic hydrocarbons with KB values as low as 36, having an Index of Refraction 1.57 and, Gardner Colour 1.

Figure 1:
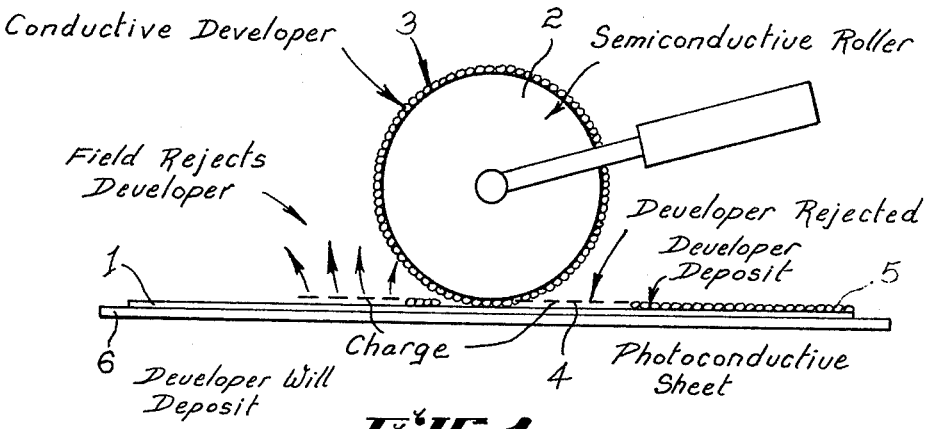
FIG. 1 shows how a master can be produced using a photoconductive sheet.

Referring first to FIG. 1, a photoconductive sheet 1 of a type as generally described earlier herein, has on the surface of a web photoconductor which is either vacuum deposited in the case of selenium or the like or bonded to the surface by resinous material in the case of zinc oxide or cadmium sulphide or the like, and an image is produced on this in the usual way of charging and light bleeding, the production of the master being then effected by passing the roller 2 over the surface, which roller 2 has previously been covered with a layer of conductive developer, or the developer can be absorbed in a spongy surface on the roller 2, so that when the roller 2 is moved over the sheet 1 the entire surface will be contacted by the developer.

Developer on the roller is indicated by 3, while the area on the photoconductive sheet which contains a charge is designated 4.

As the developer roller passes over the sheet, developer is deposited at the area 5, that is it goes down on all areas where there is no repelling field and therefore the background is in this case imaged by the conductive developer in the manner described in the specification.

A base or support is designated 6.

Figure 2:
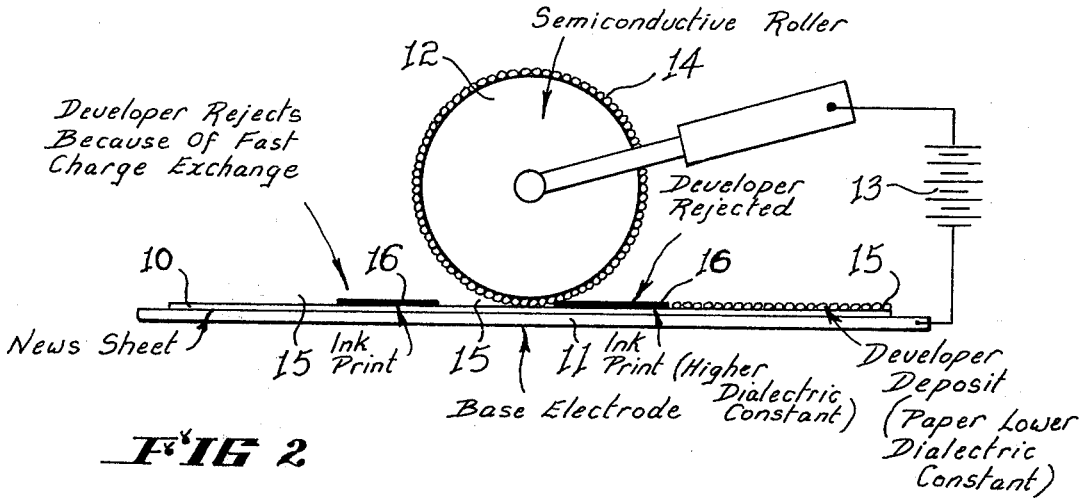
FIG. 2 shows how the master can be produced using a printed sheeet such as type written matter.

In FIG. 2 a sheet, such as news sheet or a typed sheet 10 is placed on to a base electrode 11 and the sheet 10, which will become the master, has the roller 12 passed over it, the roller 12 having a potential applied to it in relation to the base electrode 11 by means of a battery 13 or a similar device.

The roller 12 in this case again has on it a layer 14 of conductive developer and as it is passed over the sheet 10, developer deposits at the areas 15, deposition being prevented by the dielectric constant of the print or typed matter 16.

The master so produced, which can either be the master produced by the method of FIG. 1 or the method of FIG. 2, is then placed around a roller 20, although other prnting means can be used, and this roller has associated with it an inking roller 21 which can be supported from the handle 22 of the roller 20 so that as the roller 20 is rotated, the surface of the master 1 or 10 is inked by the inking roller 21, but as the master has been changed dielectrically by the conductive developer in those areas where it is present, the ink will now be applied to the receiving sheet 23 only in those areas where it is accepted by the master sheet, due to the field which exists between the roller 20 and the roller 2 and between the roller 20 and the base electrode 24 on which the receiving sheet 23 rests.

The potential is applied from means such as batteries 25 and 26, the potential between the roller 2 and the roller 20 being such as to urge the ink on to the master 1 or 10, the potential between the roller 20 and the base electrode 24 being opposite so that the ink which has been held on the master is deposited on the receiving sheet.

Figure 3:
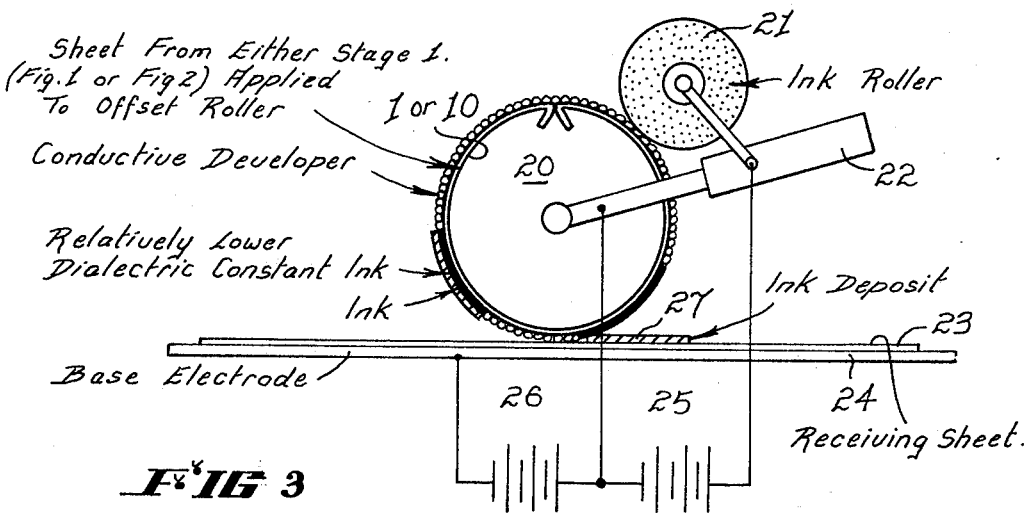
FIG. 3 shows how the master so produced can then be used to offset an inked image produced on the master to a receiving sheet, the expression "offset" in this specification being applicable either to the use of an intermediate blanket or to direct transfer from a master to a receiving sheet.

An ink deposit is designated 27 from which it will be noted that no deposit of the ink from the roller 21 takes place on those areas of the master where the conductive developer has been deposited and therefore a roller 20 such as shown in FIG. 3 can be repeatedly inked and used to deposit an image on a receiving sheet.

While in the drawings a manual device has been indicated it will of course be obvious that any other form of device can be used for applying first the conductive developer to the master sheet and subsequently the inked image to thee receiving sheet, the drawings being indicative only of the principles outlined.

We claim:

1. A method of effecting offset printing comprising applying a conductive developer to a dielectric surface in the presence of an energizing electrical image-defining field to form a master, fixing the said conductive developer to the dielectric surface whereby to have conductive and relatively insulating areas defining the image, inking the said surface in the presence of a field of a first polarity to urge the ink to the said surface whereby to retain it at the relatively insulating image areas, and transferring the ink from the said surface to a receiving surface in the presence of a second field of opposite polarity to the first field to urge the ink on to the said receiving surface, and continuing inking the said master and transferring the ink to further receiving sheets, said dielectric surface being formed by coating a base with a photoconductive layer prepared by dissolving a resin in a relatively conductive solvent and suspending the photoconductor therein in a finely divided state and evaporating free solvent, the proportions being selected so that the master has a coating with a dielectric constant greater than 3 less than 10.

2. The method according to claim 1 wherein the dielectric surface resin is selected from the group consisting of a polyvinyl butyral resin and an alkyd resin, and the solvent is selected from the group consisting of perchloroethylene, methyl ethyl ketone, acetone, and methyl alcohol.

3. The method of claim 1 wherein the said conductive developer is formed by suspending a conductive powder in a lesser amount by weight of a resin in the presence of a solvent for the resin, and the resultant concentrated developer is then dispersed in an insulating carrier liquid in an amount to leave the resultant conductive developer particles freely mobile in the said carrier liquid, the proportions being so selected that the developer has a dielectric constant substantially exceeding that of the said coating on the master and not less than 10.

4. The method of claim 3 wherein the conductive developer resin is selected from the group consisting of alkyd resin, phenolformaldehyde polymer, shellac, polyethylene, polyisobutylene, polyisoprene, polyvinylacetate, polymethylmethacrylate, cellulose, ethyl cellulose, ethyl hydrox, ethyl cellulose, cellulose acetate, polyvinylchloride, polyvinylbutyral, chlorinated rubber, polyamide and polyester.

5. The method of claim 3 wherein the conductive powder is a metal powder selected from the group consisting of aluminum bronze powder, silver, zinc, aluminum, chromium iron, copper or tin.

6. The method of effecting offset printing comprising (a) selecting a master prepared by dissolving a resin in a relatively conductive solvent and suspending a photoconductor therein which is in a finely divided state and evaporating free solvent, (b) selecting a photoconductive developer prepared by suspending a conductive powder in lesser amount by weight of a resin in the presence of a solvent, and dispersing the resultant concentrated developer in an insulating carrier liquid in an amount to leave the resultant conductive developer particles freely mobile in the said carrier liquid, said prepared surface on the master having a dielectric constant substantially less than the dielectric constant of the said developer, (c) subjecting the dielectric surface to an image to change the dielectric constant thereof imagewise, (d) subjecting the said imaged surface to said developer in the presence of the energizing electrical image-defining field to form a master, (e) fixing the said conductive developer to the dielectric surface whereby to have conductive and relatively insulating areas defining the image, (f) inking the said surface in the presence of a field of a polarity to urge the ink on to the said surface whereby to retain it at the relatively insulating image areas, (g) and transferring the ink from the said surface to a receiving surface in the presence of a field of a polarity to urge the ink on to the said receiving surface, and continuing inking the said master and transferring the ink to further receiving sheets.

* * * * *